US005140721A

United States Patent [19]

Kauffeld

[11] Patent Number: 5,140,721

[45] Date of Patent: Aug. 25, 1992

[54] THERMAL PROTECTIVE DIVING UNDERGARMENTS MADE WITH PLASTIC BUBBLE PACKING SHEETS

[76] Inventor: Robert C. Kauffeld, 1002 Echols St., Vienna, Va. 22180

[21] Appl. No.: 603,143

[22] Filed: Oct. 25, 1990

[51] Int. Cl.[5] ..... B63C 11/04

[52] U.S. Cl. ..... 2/2.1 R; 2/2

[58] Field of Search ..... 2/2, 2.1 A, 2.1 R, 161 R, 2/167

[56] References Cited

U.S. PATENT DOCUMENTS

| | | | |
|---|---|---|---|
| 2,989,752 | 6/1961 | Sloane | 2/2.1 R |
| 3,098,563 | 7/1963 | Skees | 206/46 |
| 3,392,405 | 7/1968 | Ritzinger | 2/2.1 R |
| 3,404,406 | 10/1968 | Balliet | 2/2.1 |
| 3,521,628 | 7/1970 | Piel | 128/142.5 |
| 3,675,244 | 7/1972 | Mayo et al. | 2/2.1 R |
| 3,740,764 | 6/1973 | Elfstrom | 2/2.1 R |
| 3,771,170 | 11/1973 | Leon | 2/2 |
| 4,453,271 | 6/1984 | Donzis | 2/2 |
| 4,745,635 | 5/1988 | Kinnear | 2/167 |
| 4,965,886 | 10/1990 | Ockels | 2/2.1 A |
| 5,007,111 | 4/1991 | Adams | 2/2 |

FOREIGN PATENT DOCUMENTS

| | | | |
|---|---|---|---|
| 153082 | 8/1985 | European Pat. Off. | 2/2 |
| 2823370 | 12/1979 | Fed. Rep. of Germany | 2/2 |
| 2855871 | 7/1980 | Fed. Rep. of Germany | 2/2 |
| 2188226 | 9/1987 | United Kingdom | 2/2.1 R |

*Primary Examiner*—Werner H. Schroeder
*Assistant Examiner*—Diana L. Biefeld
*Attorney, Agent, or Firm*—James C. Wray

[57] ABSTRACT

Thermal insulating underwear for divers is made from plastic laminated material with insulating gas-holding bubbles uniformly disposed over an inner surface. The materials are formed in a tube and edges are joined to form clothing. Gas trapped in bubbles throughout the clothing spaces a diver's suit away from a body, preventing heat loss by relatively efficient conduction, and providing gas-filled spaces which ensure relatively inefficient heat loss from a diver's body portions, including extremities.

20 Claims, 4 Drawing Sheets

THERMAL PROTECTIVE DIVING UNDERGARMENTS MADE WITH PLASTIC BUBBLE PACKING SHEETS

BACKGROUND OF THE INVENTION

The purpose of this invention is to provide thermal insulation for people and objects. More specifically, the invention addresses, but is not limited to, keeping divers warm while diving in dry suits in cold water.

Currently dry suits attempt to keep divers warm by first keeping them dry, and second surrounding them with a blanket of air and insulated underwear.

The problem with these suits is that, while a diver is in the water, air seeks the highest point towards the surface, because the deepest portion of a diver has the greatest exterior water pressure. That causes the insulating materials such as Cloroprene and Thinsulate to compress against the skin. Cloroprene and Thinsulate are good insulators because they trap voids of air in between their respective materials, but when these materials are compressed the voids of air are squeezed out, causing them to lose their insulating qualities and allowing heat transfer from the diver to occur more readily.

Currently dry suits are designed to provide three layers of insulation. First, an outer layer which is waterproof is usually fabricated of Neoprene or Chloroprene. The suits are usually filled with air to provide the second layer of insulation. Finally, thermal underwear such as that made from Thinsulate is worn to provide more insulation.

The problem with that design is that, when divers get into water, there is more outside pressure on the deepest portion of the diver than there is on the portions closer to the surface. That causes the air contained in the suit to rise toward the water surface. That also causes the material located at the deepest portion of the diver's suit to be squeezed against the diver's skin. The layers of insulation described above all work by trapping pockets of air in their respective materials. When those materials are compressed, air is expressed and their insulation qualities decrease dramatically. When a diver descends, those materials compress more with depth, and less effective insulation results. Also, the air that is contained in the suit rises, allowing the deepest portion of the diver to have the thinnest layer of insulation and become the coldest. The problem is especially noticeable in extremities such as feet and legs, which quickly become cold by conduction as insulating air within the suit is pressed upward by the pressure differential. Air in gloves is squeezed up toward shoulders or is released by valves at backs of gloves. Heat is quickly lost through conduction.

SUMMARY OF THE INVENTION

The present invention uses plastic bubble packing material sheets for insulation. The invention uses bubbles to protect the diver. The bubbles keep air pockets evenly distributed around the diver regardless of orientation in the water.

An undergarment made from plastic bubble sheets provides a cushion of air around a diver regardless of his position or movement in the water. Because the air in each bubble is contained, the air is not able to rise and provides insulation on all sides of the diver.

Gloves, boots and insulated underwear are made with bubble packaging sheets. Several materials could be used to fabricate the bubbles, but the important detail is that the material traps and seals pockets of air in such a way that the air cannot be squeezed out of the material and the air pockets do not compress enough to allow conduction from the skin through the material and out to the cold water. Any insulating gas such as, for example, nitrogen may replace air as the insulating gas.

The advantage of bubble insulation is that air is more evenly distributed throughout the dry suit, and air completely surrounds the diver. When a cushion of air completely surrounds the diver, heat transfer has to occur by convection from the skin to the inside of the outer shell and then by conduction through the outer shell to the cold water. With the current suits the insulated underwear and outer shell just squeeze against the skin at the deepest portion of the diver. That allows direct conduction from the skin through both the underwear and outer shell layers and then to the cold water. In that situation, heat transfer by conduction happens at a much faster rate than heat transfer by convection. The bubble sheets keep a diver warm for a much longer period of time than a material such as Thinsulate.

One possible problem with bubble insulation is that the bubbles compress with depth. That means that the deeper a diver goes, the thinner the insulation layer becomes. That amount of compression may not affect the heat transfer. If it does, each bubble may have an inlet so that air may be added during descent. Each bubble needs to have a relief valve so that air may be relieved while ascending. That air may be added from a bottle such as is currently being used on dry suits. A manifold and capillary system may distribute the air. Plain bubble sheets are sufficient in most cases. A manifold capillary system is useful for deep dives.

Each bubble in the bubble packaging material may be controlled with an inlet valve and a relief valve so air may be added while the diver descends and may be bled off when the diver ascends. Commonly used bubble sheets provide enough insulation at desired depths. Air inlets and outlets for each bubble may be added to maintain bubble dimensions and insulating qualities at depths.

The smooth plastic walls of the insulating garment have the added advantage of providing sliding surfaces for pulling on and off outer diving garments.

DETAILED DESCRIPTION OF THE DRAWINGS

Figure 1:
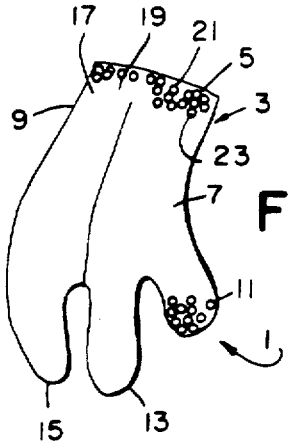
FIG. 1 shows an insulating garment in the form of an underwear glove for a diver's glove.

Referring to the drawings, an insulating undergarment in FIG. 1 is generally indicated by the numeral 1. The undergarment is a diver's underwear glove 3 having a wrist opening 5 for receiving the hand of a user. The glove has a palm-covering portion 7 and a back portion 9, a thumb-receiving portion 11 and finger-receiving portions 13 and 15.

The preferred glove is made of panels 17 of lamellar insulating material 19, having bubbles 21 of entrapped insulating gas. The bubbles 21 are filled to less than capacity so that the bubbles may deform and conform to skin surfaces when the insulating glove 3 is placed over a hand. Spaces 23 between the bubbles permit the circulation of air over the skin surface of a diver. When the bubbles 21 are compressed by increased ambient pressure experienced during a dive, inter-bubble spaces 23 maintain at least partial tracks over the surface of a user's body to promote circulation of air. In a preferred form of the invention, bubbles 21 are formed in one lamina 25 and the outer lamina 27 is smooth to aid in donning the outer diving garment 28. In a preferred form of the invention, a thin moisture-wicking insulation garment 29 is first placed on the body before placement of the insulating garment 3 to permit moisture to flow away from the interface between the bubbles and skin of a user.

Figure 2:
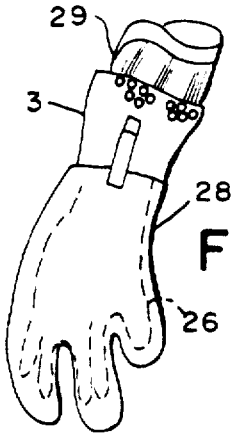
FIG. 2 shows the diver's glove being pulled over the underwear glove, which is positioned on the hand of a user.

FIG. 2 shows a user's hand 26 on which a thin wicking material glove 29 has been placed, followed by the insulating glove 3 and the outer glove 28.

Figure 3:
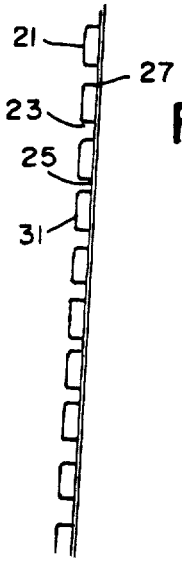
FIG. 3 is a side elevation of a preferred form of insulating material used in the insulating undergarment.

As shown in FIG. 3, the preferred insulating material is formed of plural lamina, in this case two lamina, an outer lamina 27 and an inner lamina 25 which has bubble pockets 21 inflated to less than capacity at atmospheric conditions with an insulating gas 31, for example air or nitrogen.

Figure 4:
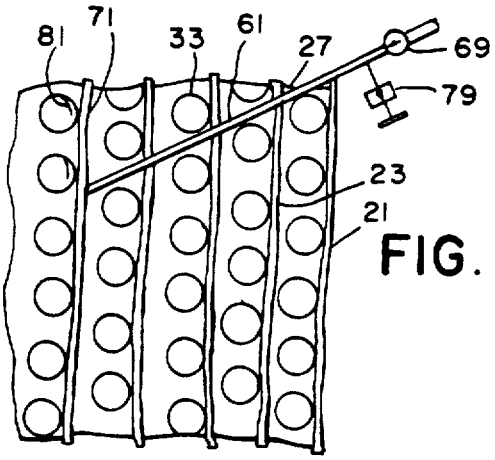
FIG. 4 is a plan view of the laminated insulating material shown in FIG. 3.

As shown in FIG. 4, the circular rim 33 of the pockets are fused or welded to the inner surface of the outer lamina 27 to enclose the pockets. Spaces 23 between the bubbles 21 shown in FIGS. 3 and 4 provide circulation. The material shown in FIGS. 3 and 4 is cut into the desired shaped panels and glued, fused and taped into the desired body-covering shapes.

Figures 5, 6:
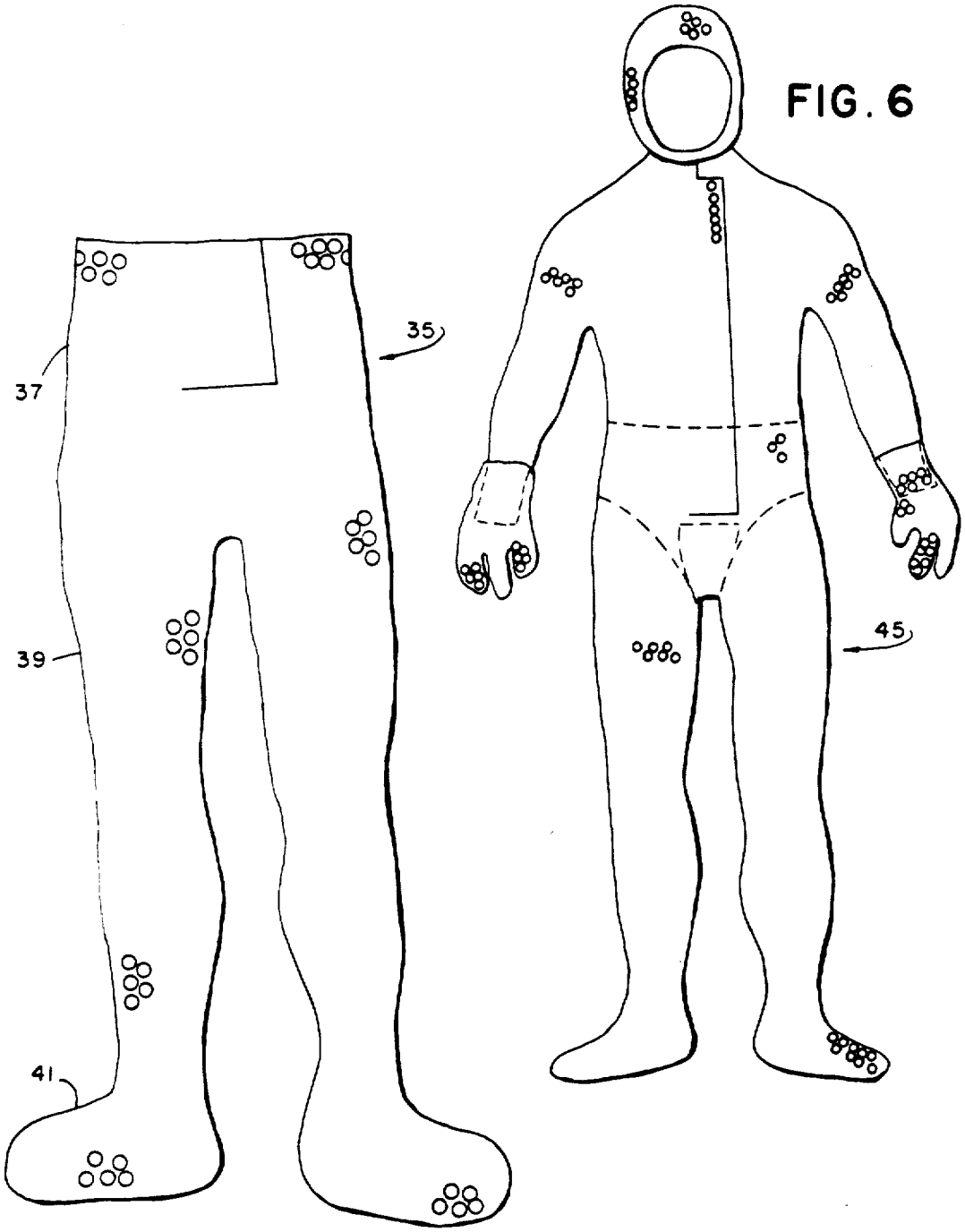
FIG. 5 is a view partially cut away of an insulating bifurcated undergarment for divers.
FIG. 6 is an overall view of a diver's insulating undergarment.

FIG. 5 shows a bifurcated insulating garment 35 with integrally formed trunk-receiving portion 37, limb- or leg-receiving portions 39, and extremities- or foot-receiving portions 41. An entire garment 45 may be constructed as shown in FIG. 6.

Figure 7:
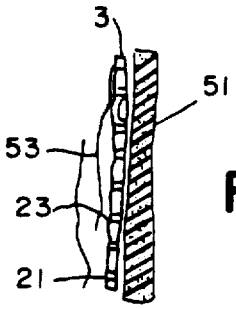
FIG. 7 shows the relation of bubble insulation to a diver's suit and skin.

While it is not necessary to wear any clothing under the insulating garment 35 or 45, a thin, wicking or washable disposable garment may be positioned between the bubbles and the body. In use, the garment 35, 45 or 3 supports the diver's suit 51, shown in FIG. 7, away from the user's body 53, preventing thermal conduction. The bubbles 21 and the spaces 23 between the bubbles both provide insulating gas-holding spaces.

Figure 8:
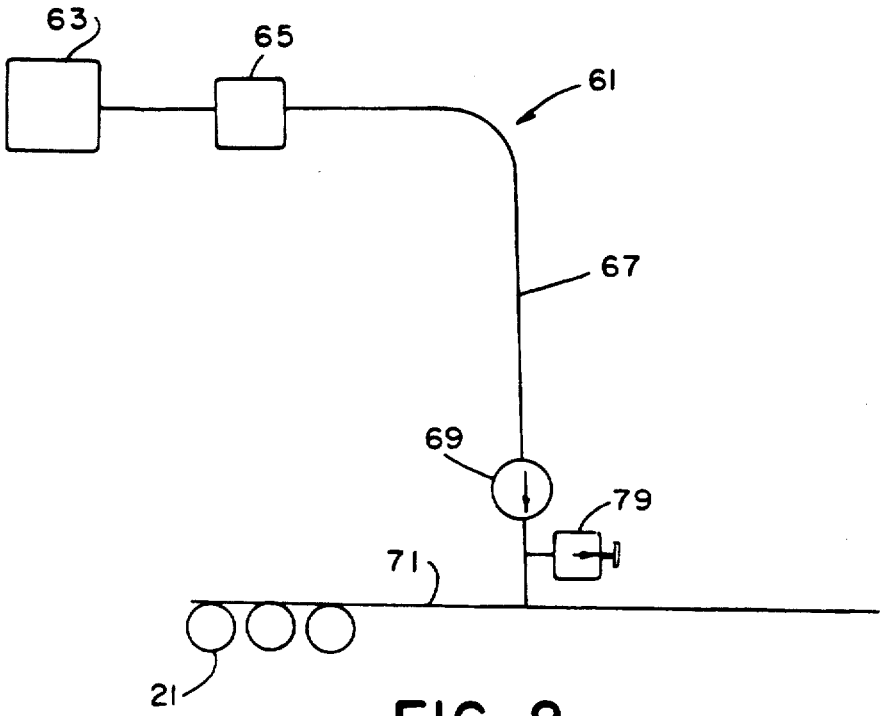
FIGS. 8 and 9 show alternate forms of filling bubbles and relieving pressure.

Referring the FIG. 8, a distribution system 61 for providing controlled pressure in the bubbles may include a source of pressure 63, a regulator 65, conduits 67 and check valves 69. Distributional tubes 71 may lead to individual bubbles 21. An excess pressure valve 79 may vent gas from the system as the gas expands upon ascent.

Figure 9:
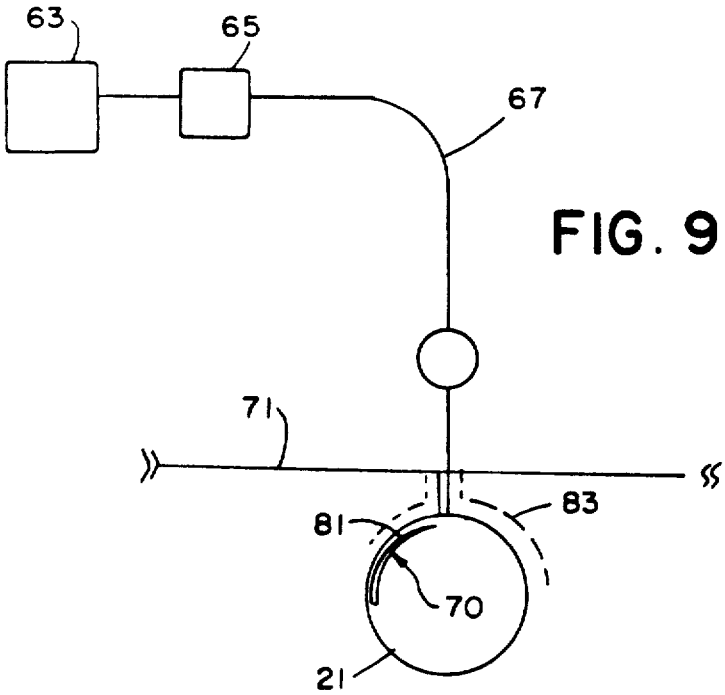

In one form of the invention as shown in FIG. 9, a simple distribution system may be used in which a regulator 65 supplies bubble inflation gas to the conduit 67, and in which the distributional lines 71 supply gas to individual bubbles 21. Individual check valves 70 such as flaps 81 in the bubbles prevent return of gas, unless the bubbles are distended 83 such as by ascent, which displaces the valve flap or the filler inlet 85 in the individual bubbles, releasing gas back to the conduit 67 and regulator 65 for venting.

FIGS. 10 through 12A schematically show problems of the prior art and solutions of the present invention. Air is represented by circles 85.

Figure 10:
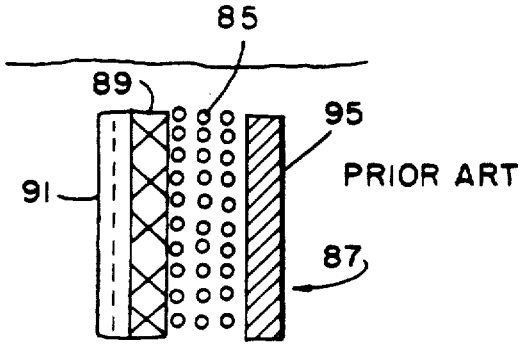
FIGS. 10 and 10A schematically show air and insulation in a diver's suit and pressure distribution before a diver enters water.
Figure 10A:
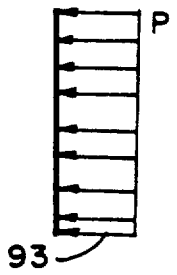

As shown in FIG. 10, insulating air 85 is uniformly distributed between a suit 87 and insulated underwear 89 on a diver's body, when the diver is above the water and when ambient atmospheric pressure 93 shown in FIG. 10A is uniformly distributed on the outer surface 95 of the suit 87.

Figure 11:
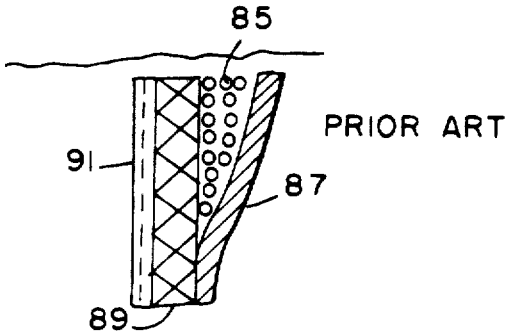
FIGS. 11 and 11A schematically show the suit and insulating air after the diver submerges.
Figure 11A:
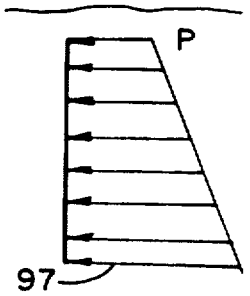

In FIG. 11, after a diver enters the water a water pressure gradient 97 in FIG. 11A acts upon outer surface 95 of suit 87 and urges air upward in the suit 87, reducing air space at the bottom, reducing convection-type insulation and increasing more efficient heat transfer by conduction.

Figure 12:
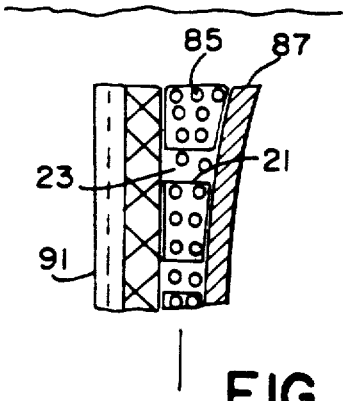
FIG. 12 and 12A schematically show correction using the present invention.
Figure 12A:
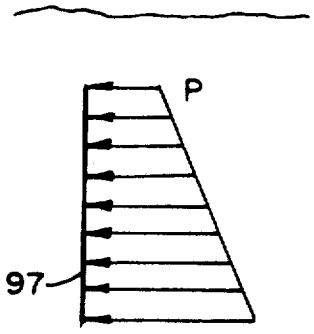

The solution of the present invention shown in FIG. 12 is to trap air in plastic bubbles 21 and to provide interspaces 23 in which the suit 87 is displaced from the body. The same underwear 89 may be worn, but the relatively inefficient heat transfer by convention through the air pockets provides effective insulation.

While the insulating underwear garments may be provided in any form, such as boots or leggings, separately or joined, or union suits with arms and legs and even head coverings as shown in FIG. 6, it is preferred that the garment be simply and cheaply constructed out of widely available bubble-containing material, for example material sold under the trademark Bubble Wrap, which is inexpensive and which is widely used in packing. The material is formed by preforming one sheet with bubble pockets, and conduits if necessary, and laminating an outer sheet by forming the outer sheet on the pocketed sheet or laying the two sheets together and fusing the sheets with heat. Alternatively, the sheets may be laid together and bubble pockets formed with heated vacuum molds before raising the inner lamina temperature to a heat-sealing temperature.

While it is preferred to wear the bubbles on the inside of the underwear garment toward the skin of the user, the underwear garment may be reversed or the bubbles may be formed on both outer sides of the lamina.

In one form of the invention, the lamina are lanced in the spaces between the bubbles to increase circulation of the insulating air in the spaces 23 between the bubbles 21.

While the invention has been described with reference to specific embodiments, modifications and variations of the invention may be constructed without departing from the scope of the invention, which is defined in the following claims.

I claim:

1. Diver underwater garment apparatus, comprising laminated plastic sheets having entrapped air bubbles formed in panels and joined together to form body covering members, plural conduits connected to the lamina and distributional tubes connected to the conduits and connected to groups of the bubbles for supplying gas to the bubbles, check valves connected to the conduits for preventing reverse flow of gas into the conduits from the bubbles, and gas release valves connected to the conduits between the check valves and the distributional tubes for selectively releasing gas from the groups of bubbles.

2. The apparatus of claim 1, wherein the laminated plastic sheets include one flat panel and one pocketed panel, wherein the flat panel forms a backing and the bubbles are formed in the pocketed panel, and wherein the garment is formed with the bubbles facing inward toward a body of the user.

3. The apparatus of claim 2, wherein the pocketed panel is joined with the flat panel forming a plurality of bubbles, wherein gas entrapped in the bubbles does not fill the bubbles at atmospheric pressure, whereby the bubbles are soft, flattenable and deformable to conform to body member shapes which the garment surrounds.

4. The apparatus of claim 3, wherein the bubbles are spaced, whereby when flattened and compressed spaces remain between the bubbles for circulating air around the bubbles.

5. The apparatus of claim 1, in which bubbles extend in opposite directions from the joined lamina.

6. The apparatus of claim 1, further comprising a fabric covering at least one surface of the bubbles.

7. The apparatus of claim 1, wherein the garment comprises a glove undergarment having a palm portion, a thumb-receiving portion, and finger-receiving portions, and wherein the bubbles project inwardly in the glove undergarment for supporting the glove undergarment on a hand of a user with spaced inner surfaces of the bubbles contacting the back, palm and wrist portions of the hand, and thumb and fingers of the hand, for holding an outer lamina of the glove undergarment away from the hand and for providing circulation between the bubbles in spaces between the bubbles.

8. The apparatus of claim 7, wherein the glove undergarment has a smooth outer surface for contacting an inner surface of a diver's glove and allowing sliding of the inner surface of the diver's glove over the outer surface of the glove undergarment.

9. The apparatus of claim 7, further comprising a thin fabric glove extending around a hand of a wearer and spacing inner surfaces of the bubbles from the hand of the wearer.

10. The apparatus of claim 1, wherein the garment is a bifurcated garment having a trunk-receiving portion and first and second limb-receiving portions, and wherein the bubbles extend inward for contacting the trunk and limb portions of a wearer, and wherein an outer surface is configured for promoting mounting of a diver's dry suit over the bifurcated garment.

11. A thermal insulating garment, comprising plural lamina of thin, flexible plastic material, at least one of the lamina being dimpled and forming cup-like pockets having closed ends facing outward from the lamina and having open ends in contact with adjacent lamina, and gas sealed within the pockets for forming bubbles in the lamina for resisting localized compression and insulating the body portion of a user positioned within the insulating garment, plural conduits connected to the lamina and distributional tubes connected to the conduits and to groups of the bubbles for supplying gas to the bubbles, and gas release valves connected to the conduits between the distributional tubes for selectively releasing gas from the groups of bubbles.

12. The apparatus of claim 11, wherein the insulating garment comprises a glove having a wrist-covering portion, a back of the hand-covering portion, a palm-covering portion and thumb- and finger-receiving portions, all of which have bubbles facing inward toward the hand, thumb and fingers for insulating the hand, thumb and fingers and for spacing lamina of the garment from the hand, thumb and fingers.

13. The apparatus of claim 12, wherein the bubbles are spaced from each other for promoting circulation through the glove among the bubbles.

14. The apparatus of claim 11, wherein the bubbles are partially inflated with an insulating gas, whereby applying transverse pressure tends to flatten the bubbles against the body of a user.

15. A thermal insulating diver's garment, comprising a thin, laminated, flexible panel having first and second opposite surfaces, at least one of the surfaces being formed with gas holding pockets for holding insulating gas, the panel being wrapped into a tube, and edges of the panel being joined, forming a fixed tubular structure with the first and second surfaces becoming inner and outer surfaces of the fixed tubular structure, the outer surface being configured for positioning within an inner wall of a diver's suit, and the inner surface being configured for surrounding a body member of a diver, whereby insulating gas trapped in the pockets of the tubular structure spaces the diver's suit from a body member of the diver and insulates the diver by low efficiency heat transfer convention-type insulation, plural conduits connected to the lamina and distributional lines connected to the conduits and to groups of the pockets for supplying gas to the pockets, and gas release valves connected to the conduits for selectively releasing gas from the groups of bubbles.

16. The apparatus of claim 15, wherein the tubular structure is formed with gas-holding pockets on an inner surface, whereby gas within the pockets holds the outer surface of the tubular structure as well as the diver's suit away from the body member.

17. The apparatus of claim 16, wherein the inner surface of the tubular structure forms a body extremity-receiving cavity open at a proximal end for receiving a limb portion, and closed at a distal end for holding the extremity within the tubular structure.

18. The apparatus of claim 16, wherein the apparatus comprises a tubular trunk-receiving portion and tubular limb-receiving portions extending from the tubular trunk-receiving portion.

19. The apparatus of claim 15, wherein the distributional lines are connected to the pockets for filling the pockets with gas, and valves are connected for releasing gas from the pockets as the pockets are distended by ascent.

20. The apparatus of claim 15, further comprising a gas source, a regulator connected to the source, wherein the conduits are connected to the regulator and the distributional lines are connected to the conduits and to the pockets for filling the pockets and for flowing gas out of the pockets upon ascent.

* * * * *